US009829269B2

(12) United States Patent
McPherson

(10) Patent No.: US 9,829,269 B2
(45) Date of Patent: Nov. 28, 2017

(54) ARCHERY BOW CABLE RETAINER

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 3 days.

(21) Appl. No.: 14/918,265

(22) Filed: Oct. 20, 2015

(65) Prior Publication Data

US 2017/0108308 A1 Apr. 20, 2017

(51) Int. Cl.
*F41B 5/14* (2006.01)
*F41B 5/10* (2006.01)

(52) U.S. Cl.
CPC ..... *F41B 5/1403* (2013.01); *F41B 5/10* (2013.01)

(58) Field of Classification Search
CPC .. F41B 5/10; F41B 5/1403; F41B 5/14; F41B 5/1426; F41B 5/123; F41B 5/148
See application file for complete search history.

(56) References Cited

U.S. PATENT DOCUMENTS

| | | | | |
|---|---|---|---|---|
| 2,617,402 | A | 11/1952 | Roemer | |
| 3,012,552 | A | 12/1961 | Allen | |
| 3,059,370 | A | 10/1962 | Moore | |
| 3,070,083 | A | 12/1962 | Gubash | |
| 3,258,000 | A | 6/1966 | Kolpacki | |
| 3,658,157 | A | 4/1972 | Lee | |
| 3,757,761 | A | 9/1973 | Izuta | |
| 4,061,125 | A | 12/1977 | Trotter | |
| 4,207,858 | A | 6/1980 | Blackstone | |
| 4,461,267 | A | 7/1984 | Simonds et al. | |
| 4,628,892 | A | 12/1986 | Windedahl et al. | |
| 4,903,678 | A * | 2/1990 | Walker | F41B 5/10 124/25.6 |
| 4,917,070 | A | 4/1990 | Townsend | |
| 4,919,108 | A * | 4/1990 | Larson | F41B 5/10 124/25.6 |
| 5,323,756 | A | 6/1994 | Rabska | |
| 5,415,149 | A | 5/1995 | Derus et al. | |
| 5,452,704 | A | 9/1995 | Winebarger | |
| 5,718,213 | A | 2/1998 | Gallops, Jr. et al. | |
| 5,720,269 | A | 2/1998 | Saunders | |
| 5,722,385 | A * | 3/1998 | Bunk | F41B 5/10 124/25.6 |
| 5,983,880 | A | 11/1999 | Saunders | |
| 6,257,220 | B1 | 7/2001 | McPherson et al. | |
| 6,382,201 | B1 | 5/2002 | McPherson et al. | |
| 6,681,753 | B2 | 1/2004 | Afshari | |
| 6,681,754 | B1 | 1/2004 | Angeloni | |
| 6,681,755 | B2 | 1/2004 | Pujos | |
| 6,722,354 | B1 | 4/2004 | Land | |

(Continued)

*Primary Examiner* — Melba Bumgarner
*Assistant Examiner* — Amir Klayman

(57) ABSTRACT

In some embodiments, an archery bow comprises a riser, a first limb supporting a first rotatable member and a second limb supporting a second rotatable member. First and second cable segments extend between the first rotatable member and the second rotatable member. A cable guard is supported by the riser, which comprises a first roller and a second roller. The first roller is in contact with the first cable segment and the second roller is in contact with the second cable segment. The first roller has a first diameter and the second roller has a second diameter different from the first diameter.

16 Claims, 6 Drawing Sheets

(56) References Cited

U.S. PATENT DOCUMENTS

| | | | | |
|---|---|---|---|---|
| 6,966,314 | B2 | 11/2005 | McPherson | |
| 7,793,646 | B2 | 9/2010 | Cooper et al. | |
| 8,011,356 | B2 | 9/2011 | Gordon et al. | |
| RE42,842 | E | 10/2011 | McPherson | |
| 8,028,685 | B2 | 10/2011 | Clark | |
| 8,056,548 | B1 | 11/2011 | Larson | |
| 8,176,906 | B2 | 5/2012 | Simo et al. | |
| 8,616,189 | B2 * | 12/2013 | McPherson | F41B 5/10 124/23.1 |
| 8,746,219 | B2 * | 6/2014 | Anselmo | F41B 5/10 124/25.6 |
| 9,291,422 | B1 * | 3/2016 | Gold | F41B 5/1403 |
| 2003/0136392 | A1 | 7/2003 | McPherson | |
| 2008/0127961 | A1 | 6/2008 | McPherson | |
| 2010/0083943 | A1 | 4/2010 | Grace et al. | |
| 2010/0132685 | A1 | 6/2010 | De Sousa | |
| 2010/0224178 | A1 | 9/2010 | McPherson | |
| 2010/0282226 | A1 | 11/2010 | Marzullo | |
| 2010/0319670 | A1 | 12/2010 | Sims et al. | |
| 2011/0011385 | A1 | 1/2011 | Grace, Jr. et al. | |
| 2011/0048394 | A1 | 3/2011 | Simo et al. | |
| 2011/0073090 | A1 * | 3/2011 | McPherson | F41B 5/10 124/25.6 |
| 2011/0192385 | A1 | 8/2011 | Clark | |
| 2011/0247602 | A1 | 10/2011 | McPherson | |
| 2012/0042861 | A1 | 2/2012 | Anselmo | |
| 2012/0042864 | A1 | 2/2012 | McPherson | |
| 2013/0061838 | A1 * | 3/2013 | Gordon | F41B 5/14 124/25.6 |
| 2014/0196706 | A1 | 7/2014 | McPherson | |

* cited by examiner

ARCHERY BOW CABLE RETAINER

BACKGROUND OF THE INVENTION

This invention relates generally to archery bows and more specifically to archery bows comprising cable positioners and/or retainers.

Compound archery bows are generally known in the art. Compound bows typically include a bowstring, as well as one or more cable segments. Cable guards are often used to bias the cable segments in a lateral direction, holding the cables away from the arrow shooting axis.

Although cable guards provide benefits, there are also related consequences. For example, cable guards may contribute to limb twist and cam lean.

There remains a need for novel bow and cable guard designs that minimize the consequences of biasing cables laterally.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser, a first limb supporting a first rotatable member and a second limb supporting a second rotatable member. First and second cable segments extend between the first rotatable member and the second rotatable member. A cable guard is supported by the riser, which comprises a first roller and a second roller. The first roller is in contact with the first cable segment and the second roller is in contact with the second cable segment. The first roller has a first diameter and the second roller has a second diameter different from the first diameter.

In some embodiments, a cable guard comprises a body comprising an axle, a first roller and a second roller sized differently from the first roller. The cable guard includes a retainer comprising a first portion and a second portion sized differently from the first portion. The first portion is located adjacent to the first roller and the second portion is located adjacent to the second roller.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
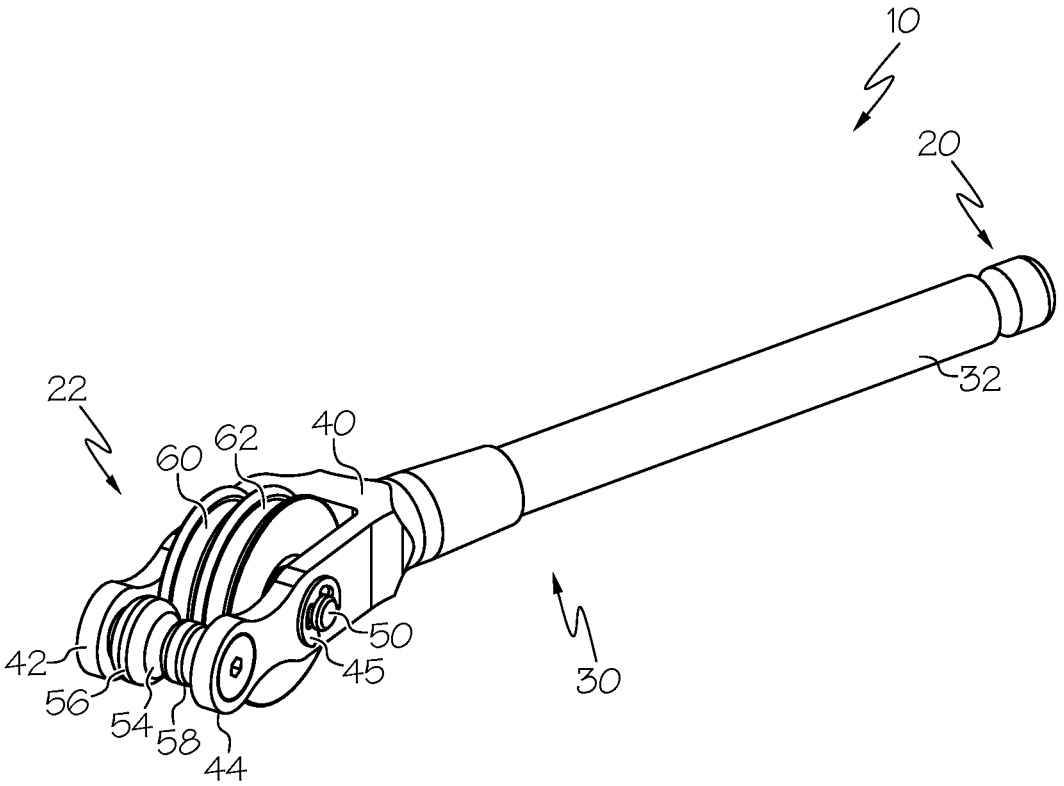
FIG. 1 shows an embodiment of a cable guard.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a cable guard 10. In some embodiments, a cable guard 10 comprises a first portion 20 arranged to be supported by an archery bow and a second portion 22 arranged to engage one or more archery bow cables.

Figure 2:
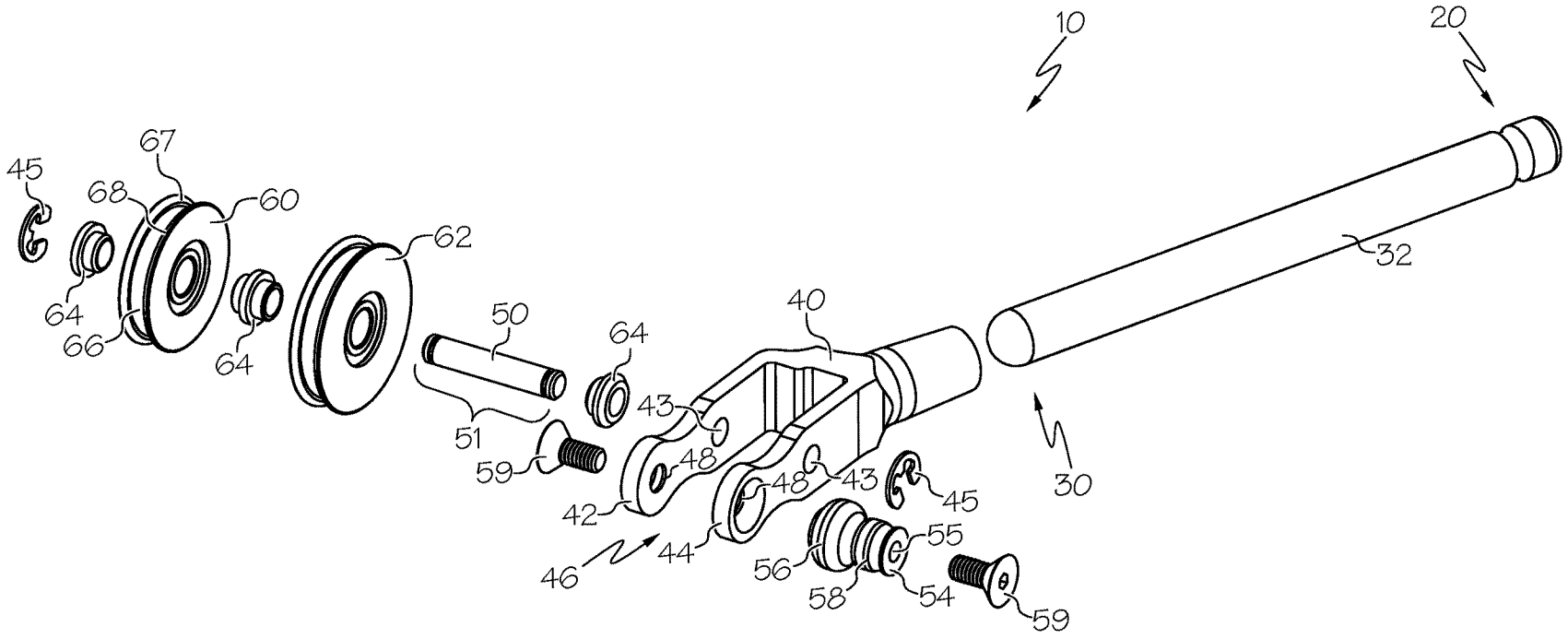
FIG. 2 shows an exploded view of the cable guard of FIG. 1.

FIG. 2 shows an exploded view of the cable guard 10 shown in FIG. 1.

With reference to FIGS. 1 and 2, desirably, the cable guard 10 comprises a body 30. In some embodiments, the body 30 comprises an elongate portion 32 and a frame 40. In some embodiments, the elongate portion 32 comprises a shaft. In some embodiments, the elongate portion 32 comprises a circular cross-sectional shape.

In some embodiments, the frame 40 is fixedly attached to a separate elongate portion 32. In some embodiments, the frame 40 and elongate portion 32 are integral, for example comprising a single piece of material.

In some embodiments, the frame 40 comprises a first arm 42 and a second arm 44. In some embodiments, a cavity 46 is defined between the first arm 42 and the second arm 44.

In some embodiments, the cable guard 10 comprises an axle 50. In some embodiments, the axle 50 extends between the first arm 42 and the second arm 44, and at least a portion of the axle 50 is oriented in the cavity 46. In some embodiments, each arm 42, 44 comprises an aperture 43, and the axle 50 extends through the aperture(s) 43. In some embodiments, the axle 50 is retained in position by clips 45 that are received in respective grooves 51 in the axle 50.

In some embodiments, the cable guard 10 comprises a first roller 60. In some embodiments, the cable guard 10 comprises a second roller 62. In some embodiments, the rollers 60, 61 are supported by the axle 50 and arranged to rotate with respect to the body 30. In some embodiments, one or more bushings 64 are provided for each roller 60, 61. The roller(s) 60, 61 can contact the bushings 64 and in some embodiments do not contact the axle 50 directly.

In some embodiments, the second roller 62 is sized differently from the first roller 60. In some embodiments, the first roller 60 defines a first diameter and the second roller 62 defines a second diameter that is different from the first diameter. In some embodiments, the first roller 60 is smaller than the second roller 62. In some embodiments, the first roller 60 has a smaller diameter than the second roller 62.

In some embodiments, a roller 60, 62 comprises a peripheral groove 66 suitable for receiving a cable of an archery bow. In some embodiments, a roller 60, 62 comprises a first flange 67 and a second flange 68, and a peripheral groove 66 is located between the flanges 67, 68.

In some embodiments, the peripheral groove 66 of the second roller 62 is sized differently from the peripheral groove 66 of the first roller 60. In some embodiments, a surface of the peripheral groove 66 of the first roller 60 defines a first diameter and a surface of the peripheral groove 66 of the second roller 62 defines a second diameter that is different from the first diameter. In some embodiments, the peripheral groove 66 of the first roller 60 is smaller than the peripheral groove 66 of the second roller 62. In some embodiments, the peripheral groove 66 of the first roller 60 has a smaller diameter than the peripheral groove 66 of the second roller 62.

In some embodiments, a cable guard 10 comprises a retainer 54. In some embodiments, a retainer 54 is arranged to retain archery bow cables and prevent such cables from being disengaged from the cable guard 10. In some embodiments, a retainer 54 is positioned in the cavity 46 defined by the frame 40. In some embodiments, the frame 40 and the retainer 54 collectively surround one or more archery bow cables.

In some embodiments, a retainer 54 comprises a first portion 56 and a second portion 58 sized differently from the first portion 56. In some embodiments, the first portion 56 is larger than the second portion 58. In some embodiments, the retainer is positioned such that the first portion 56 is located adjacent to the first roller 60 and the second portion 58 is located adjacent to the second roller 62.

In some embodiments, the retainer 54 is engaged to the frame 40 using one or more fasteners 59. In some embodiments, a fastener 59 is received in a cavity 55 formed in the retainer 54. In some embodiments, the frame 40 comprises one or more apertures 48, and a fastener 59 extends through an aperture 48 and engages the retainer 54. In some embodiments, a first portion of the retainer 54 engages the first arm 42 of the frame, and a second portion of the retainer 54 engages the second arm 44 of the frame 40.

In some embodiments, the retainer 54 comprises a circular cross-sectional shape. In some embodiments, the first portion 56 and the second portion 58 each comprise a circular cross-sectional shape. In some embodiments, the first portion 56 has a greater diameter than the second portion 58.

Figure 3:
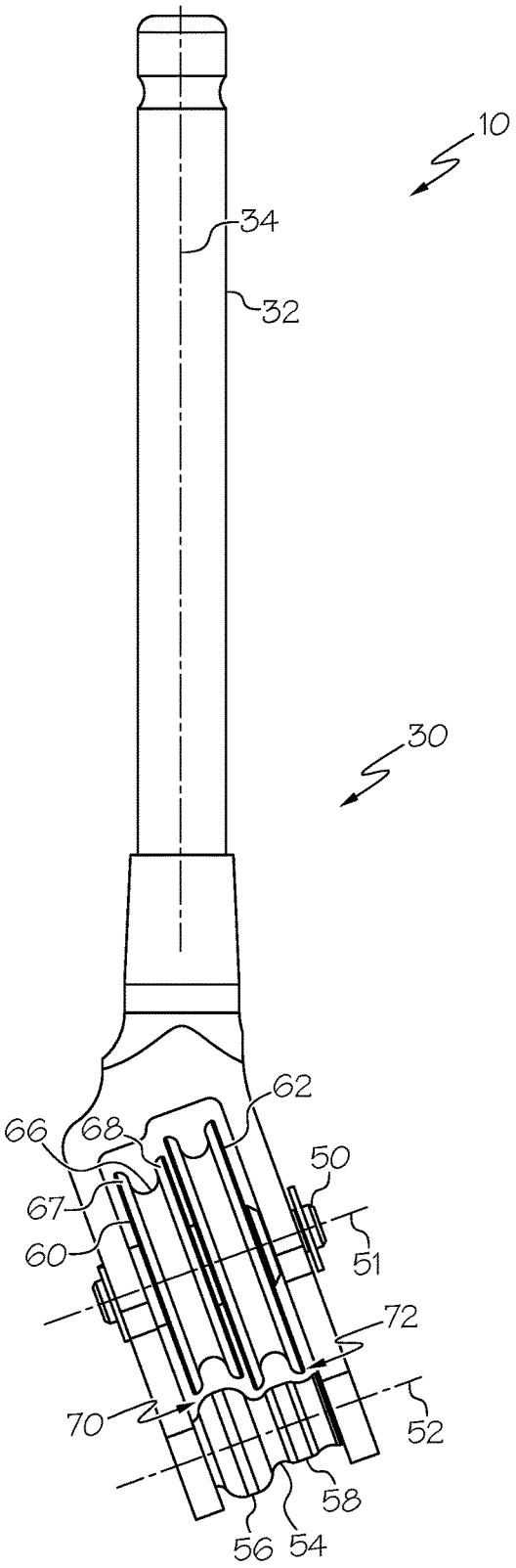
FIG. 3 shows a top view of the cable guard of FIG. 1.

FIG. 3 shows a top view of the cable guard 10 shown in FIG. 1. In some embodiments, the elongate portion 32 of the body 30 comprises a longitudinal axis 34 that is straight along its length. In some embodiments, the longitudinal axis 34 comprises a central axis, for example when the elongate portion is circular or tubular. When the cable guard 10 is installed on an archery bow, the longitudinal axis 34 is desirably arranged substantially parallel to the bow's shooting axis 18 (see FIG. 4).

In some embodiments, the retainer 54 defines a longitudinal axis 52 that is straight along its length. In some embodiments, the axle 50 defines a longitudinal axis 51 that is straight along its length. In some embodiments, the longitudinal axis 52 of the retainer 54 is parallel to the longitudinal axis 51 of the axle 50.

In some embodiments, the longitudinal axis 51 of the axle 50 is oriented at a non-zero angle to the longitudinal axis 34 of the elongate portion 32. In some embodiments, an angle between the longitudinal axis 51 of the axle 50 and the longitudinal axis 34 of the elongate portion 32 is greater than zero degrees and less than ninety degrees. In some embodiments, an angle between the longitudinal axis 51 of the axle 50 and the longitudinal axis 34 of the elongate portion 32 is greater than sixty degrees and less than eighty degrees. In some embodiments, an angle between the longitudinal axis 51 of the axle 50 and the longitudinal axis 34 of the elongate portion 32 is approximately seventy degrees.

In some embodiments, the longitudinal axis 52 of the retainer 54 is oriented at a non-zero angle to the longitudinal axis 34 of the elongate portion 32. In some embodiments, an angle between the longitudinal axis 52 of the retainer 54 and the longitudinal axis 34 of the elongate portion 32 is greater than zero degrees and less than ninety degrees. In some embodiments, an angle between the longitudinal axis 52 of the retainer 54 and the longitudinal axis 34 of the elongate portion 32 is greater than sixty degrees and less than eighty degrees. In some embodiments, an angle between the longitudinal axis 52 of the retainer 54 and the longitudinal axis 34 of the elongate portion 32 is approximately seventy degrees.

In some embodiments, an archery bow cable is received in a portion of a peripheral groove 66 of a roller, and the retainer 54 is arranged to prevent the cable from moving out of the peripheral groove 66. In some embodiments, a gap 70 is defined between the first roller 60 and the first portion 56 of the retainer 54, and a distance across the gap 70 is less than a width of the peripheral groove 66 of the first roller 60. In some embodiments, a gap 72 is defined between the second roller 66 and the second portion 58 of the retainer 54, and a distance across the gap 72 is less than a width of the peripheral groove 66 of the second roller 62.

Figure 4:
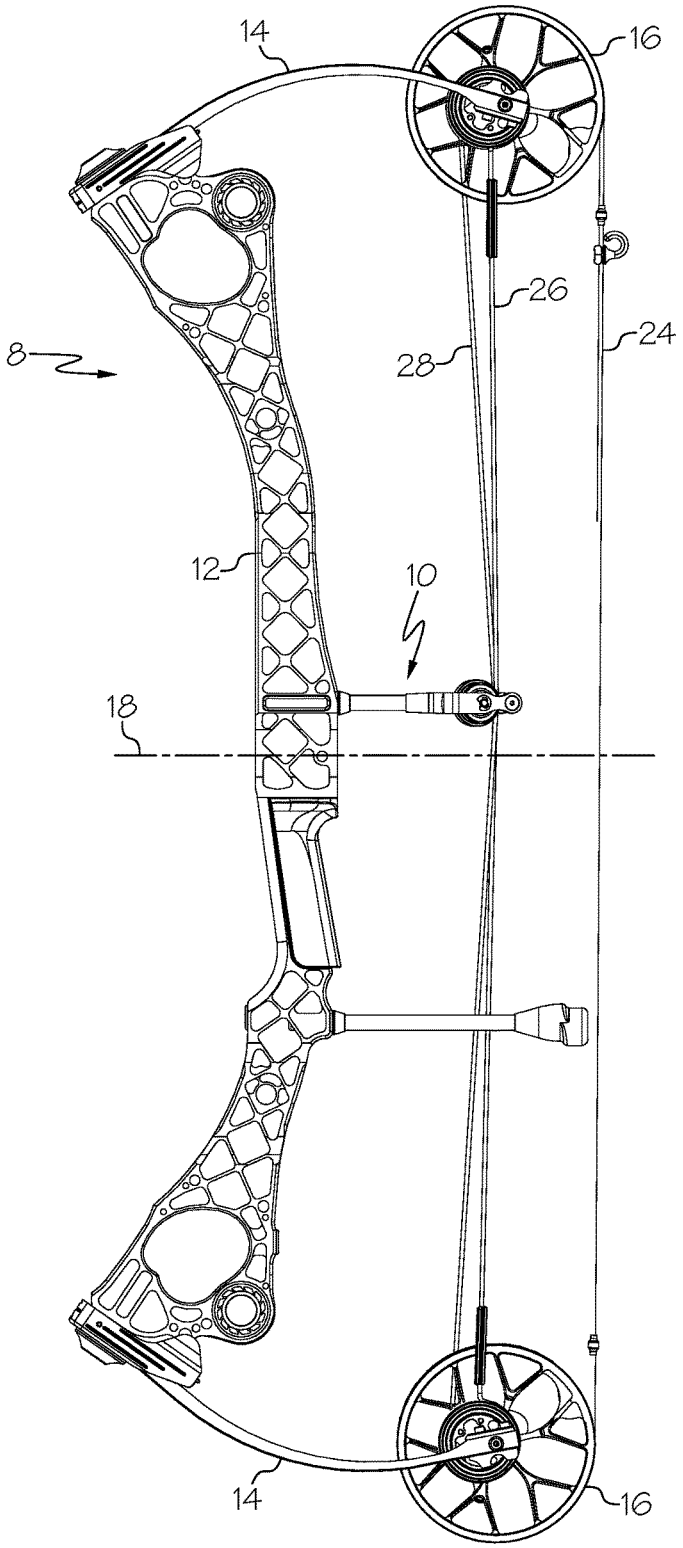
FIG. 4 shows an embodiment of an archery bow.
Figure 5:
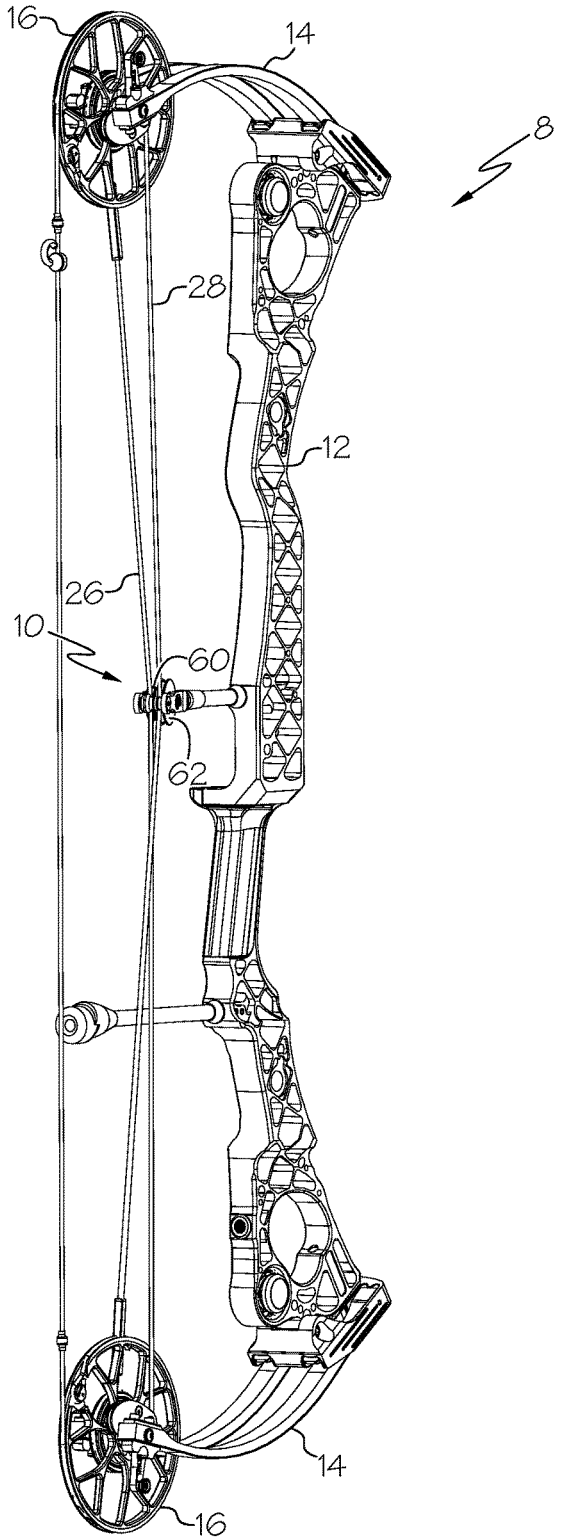
FIG. 5 shows the bow of FIG. 4 from a different viewing angle.

FIGS. 4 and 5 show an embodiment of a cable guard 10 attached to an archery bow 8. In some embodiments, a bow 8 comprises a riser 12, limbs 14, rotating members 16, a bowstring 24, a first cable segment 26 and a second cable segment 28. The bow 8 shown in FIG. 4 comprises a two-cam bow, wherein the first cable segment 26 comprises a first power cable and a second cable segment 28 comprises a second power cable. The invention is also directed to other configurations of compound bows, such as single cam bows, hybrid/cam-and-a-half bows, etc. For example, in a one-cam bow, the second cable segment 28 can comprise a control cable segment, and a single stretch of cable can comprise both a bowstring segment and a control cable segment.

Desirably, the cable guard 10 engages the first cable segment 26 and the second cable segment 28, biasing each segment 26, 28 away from the shooting axis 18, for example in a lateral direction. In some embodiments, the first roller 60 engages the first cable segment 26 and the second roller 62 engages the second cable segment 28.

Figure 6:
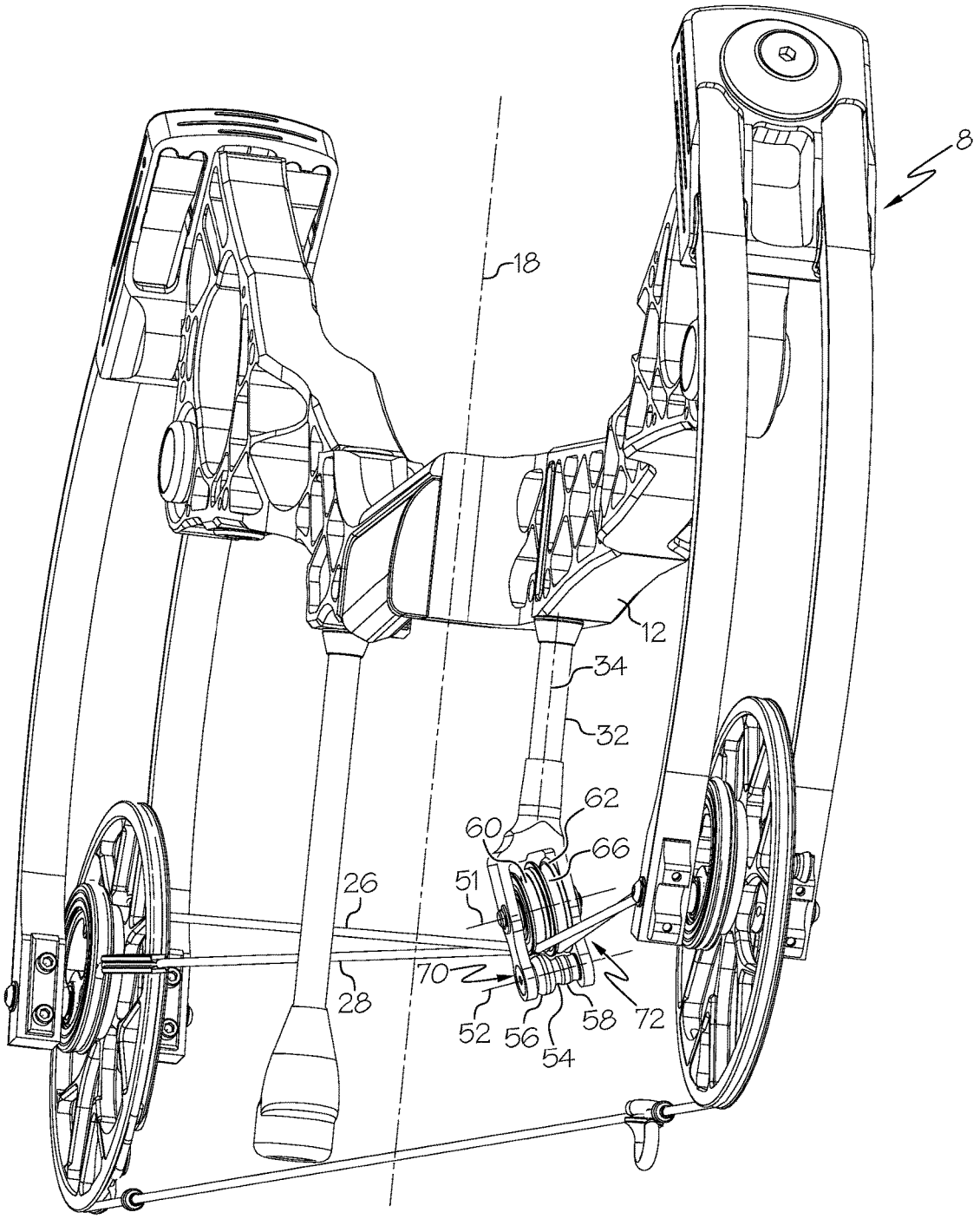
FIG. 6 shows the bow of FIG. 4 with a cable guard in greater detail.

FIG. 6 shows the bow 8 of FIGS. 4 and 5 from another viewing angle. In some embodiments, the longitudinal axis 52 of the retainer 54 is oriented at a non-zero angle to the shooting axis 18 of the bow 8. In some embodiments, an angle between the longitudinal axis 52 of the retainer 54 and the shooting axis 18 is greater than zero degrees and less than ninety degrees. In some embodiments, an angle between the longitudinal axis 52 of the retainer 54 and the shooting axis 18 is greater than sixty degrees and less than eighty degrees. In some embodiments, an angle between the longitudinal axis 52 of the retainer 54 and the shooting axis 18 is approximately seventy degrees.

In some embodiments, a first cable segment 26 is received in a portion of a peripheral groove 66 of the first roller 60, and the retainer 54 is arranged to prevent the first cable segment 26 from moving out of the peripheral groove 66. In some embodiments, a gap 70 is defined between the first roller 60 and the first portion 56 of the retainer 54, and a distance across the gap 70 is less than a diameter of the first cable segment 26. In some embodiments, a second cable segment 28 is received in a portion of a peripheral groove 66 of the second roller 66, and the retainer 54 is arranged to prevent the second cable segment 28 from moving out of the peripheral groove 66. In some embodiments, a gap 72 is defined between the second roller 66 and the second portion 58 of the retainer 54, and a distance across the gap 72 is less than a diameter of the second cable segment 28.

In some embodiments, the orientation of the axle axis 51 combined with first and second rollers 60, 62 of different size provides for the first and second cable segments 26, 28 to be positioned an equal distance from the riser 12. For example, a distance between the location the first roller 60 contacts the first cable segment 26 and the riser 12 can be the same as a distance between the location the second roller 62 contacts the second cable segment 28 and the riser 12. The distances can be measured in a direction parallel to the shooting axis 18 or parallel to the longitudinal axis 34 of the elongate portion 32.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A cable guard comprising:

a body comprising a frame defining a cavity, the frame defining an opening into said cavity, said body supporting an axle;

a first roller supported by the axle;

a second roller supported by the axle, the second roller sized differently from the first roller, a diameter of the first roller being less than a diameter of the second roller; and a retainer arranged to close the opening into said cavity, the retainer comprising a first portion and a second portion sized differently from the first portion, the first portion comprising a circular cross-sectional shape, the second portion comprising a circular cross-sectional shape, a diameter of the first portion being greater than a diameter of the second portion, the first portion located adjacent to the first roller, the second portion located adjacent to the second roller, the retainer attached to the frame by a fastener, the retainer being disengageable from said frame.

2. The cable guard of claim 1, said retainer having a longitudinal axis that is parallel to said axle.

3. The cable guard of claim 1, said body comprising a shaft portion having a longitudinal axis oriented at a non-zero angle to said axle.

4. The cable guard of claim 3, wherein said angle is less than 90 degrees.

5. The cable guard of claim 1, said first roller comprising a peripheral groove located between a first flange and a second flange, a gap between the first roller and the retainer first portion being less than a distance between the first flange and the second flange.

6. The cable guard of claim 1, the frame comprising a first arm and a second arm, the first arm attached to the axle, the first arm attached to the retainer.

7. The cable guard of claim 6, the second arm attached to the axle, the second arm attached to the retainer.

8. The cable guard of claim 6, the first arm and the second arm defining the cavity, the retainer positioned in the cavity.

9. The cable guard of claim 1, the first roller comprising a first peripheral groove, the second roller comprising a second peripheral groove, a diameter of the first peripheral groove being different from a diameter of the second peripheral groove.

10. An archery bow comprising:

a riser;

a first limb supporting a first rotatable member;

a second limb supporting a second rotatable member;

first and second cable segments extending between the first rotatable member and the second rotatable member;

a cable guard supported by the riser, the cable guard comprising a frame, a retainer, an axle supporting a first roller and a second roller, the frame defining a cavity and an opening into said cavity, the first roller positioned in said cavity and in contact with the first cable segment, the second roller positioned in said cavity and in contact with the second cable segment, the first roller having a first diameter, the second roller having a second diameter greater than the first diameter, the retainer arranged to close the opening into said cavity, the retainer attached to the frame by a fastener, the retainer being disengageable from said frame, the retainer comprising a first portion comprising a circular cross-sectional shape and a second portion comprising a circular cross-sectional shape, a diameter of the first portion being greater than a diameter of the second portion, the first portion located adjacent to the first roller, the second portion located adjacent to the second roller.

11. The archery bow of claim 10, wherein a gap between the first roller and the retainer first portion is less than a diameter of the first cable segment.

12. The archery bow of claim 11, wherein a gap between the second roller and the retainer second portion is less than a diameter of the second cable segment.

13. The archery bow of claim 10, the cable guard comprising an axle supporting the first roller and the second roller, the retainer having a central axis oriented parallel to the axle.

14. The archery bow of claim 13, the bow defining a shooting axis, the central axis of the retainer oriented at a non-zero angle to the shooting axis.

15. The archery bow of claim 10, the first roller contacting the first cable at a first location, the second roller contacting the second cable at a second location, wherein a distance between the riser and the first location is equal to a distance between the riser and the second location.

16. The archery bow of claim 10, the first roller comprising a first peripheral groove, the second roller comprising a second peripheral groove, a diameter of the first peripheral groove being different from a diameter of the second peripheral groove.

* * * * *